US009661962B2

(12) United States Patent
Li et al.

(10) Patent No.: US 9,661,962 B2
(45) Date of Patent: May 30, 2017

(54) QUICK ASSEMBLY AND DISASSEMBLY DEVICE OF A TOILET COVER AND IMPLEMENTATION METHOD THEREOF

(71) Applicant: Feiyu Li, Xiamen, Fujian (CN)

(72) Inventors: Feiyu Li, Xiamen (CN); Huiqing Wang, Xiamen (CN); Yuzhi Liu, Xiamen (CN); Baojia Huang, Xiamen (CN)

(73) Assignee: Feiyu Li, Xiamen (CN)

( * ) Notice: Subject to any disclaimer, the term of this patent is extended or adjusted under 35 U.S.C. 154(b) by 243 days.

(21) Appl. No.: 14/407,162

(22) PCT Filed: May 26, 2014

(86) PCT No.: PCT/CN2014/078362

§ 371 (c)(1),
(2) Date: Dec. 11, 2014

(87) PCT Pub. No.: WO2014/190877

PCT Pub. Date: Dec. 4, 2014

(65) Prior Publication Data

US 2015/0157179 A1 Jun. 11, 2015

(30) Foreign Application Priority Data

May 28, 2013 (CN) ..... 2013 1 0205332

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01); *Y10T 29/49826* (2015.01)

(58) Field of Classification Search
CPC .... A47K 13/12; A47K 13/26; Y10T 29/49826
USPC ..... 4/236
See application file for complete search history.

(56) References Cited

FOREIGN PATENT DOCUMENTS

| | | | |
|---|---|---|---|
| CN | 201481293 | U | 5/2010 |
| CN | 202426440 | U | 9/2012 |
| CN | 202723749 | U | 2/2013 |
| CN | 103099580 | A | 5/2013 |
| CN | 202920065 | U | 5/2013 |
| DE | 202009008303 | U1 | 8/2009 |

*Primary Examiner* — Tuan N Nguyen
(74) *Attorney, Agent, or Firm* — Rabin & Berdo, P.C.

(57) ABSTRACT

A toilet cover and an implementation method thereof includes a toilet seat, a toilet top cover, a rotation mechanism and two supports, two supports are respectively disposed with an insert pin, each insert pin is disposed with a lock groove at the side wall of the top portion, the rotation mechanism is disposed with two radial insert holes for the insert pins to insert; wherein further comprising at least one switch component disposed at the external wall of the two supports, a lock element and an elastic element, both ends of the lock element are respectively disposed with a lock catch to lock to the lock groove of the insert pin or release the lock, the switch component drives the lock element to move so as to release the lock; the lock element is repositioned by the elastic element.

21 Claims, 17 Drawing Sheets

QUICK ASSEMBLY AND DISASSEMBLY DEVICE OF A TOILET COVER AND IMPLEMENTATION METHOD THEREOF

FIELD OF THE INVENTION

The present invention relates to a quick assembly and disassembly device of a toilet cover, especially to a quick assembly and disassembly device of a toilet cover and an implementation method thereof.

BACKGROUND OF THE INVENTION

Toilets are used in many places in the daily life, they are necessary sanitary wares in people's life. When the toilet is used, the toilet cover, the toilet seat and the connection device between the toilet cover and the toilet seat need to be clean and or repaired, so it is important to realize quick assembly and disassembly between the toilet cover and the toilet seat. To solve the problem, there are quick assembly and disassembly devices of toilet cover existing, thereinto, quick assembly and disassembly devices of toilet cover applied with button have following three types: central single-button type, central double-button type and single-button side-press type, however, these three types have disadvantages when used: The central single-button type quick assembly and disassembly device has dead space when disassembled, that is to say, when the toilet cover is lifted to a certain angle, it will cover the button at the central of the rear end of the toilet cover, making it unable to disassemble; if this kind of quick assembly and disassembly device is disposed with a groove at the center, it affects the appearance, besides, the groove is easy to be polluted, making it uneasy to clean; except for above disadvantages, the double-button type quick assembly and disassembly device needs to be pressed twice when disassembled or assembled, it is inconvenient to operate; double-button side-press type quick assembly and disassembly device needs two sets of quick assembly and disassembly device, thus making it complicated and inconvenient to operate.

SUMMARY OF THE INVENTION

The object of the present invention is to overcome the disadvantages of the existing technology and provide with a quick assembly and disassembly device of a toilet cover, which is simple structural, easy to operate, free dead space and easy to clean.

The technical proposal of the present invention to solve the technical problems is that: a quick assembly and disassembly device of a toilet cover, comprising a toilet seat, a toilet top cover, a rotation mechanism and two supports, two supports are respectively disposed with an insert pin, each insert pin is disposed with a lock groove at the side wall of the top portion, the rotation mechanism is disposed with two radial insert holes for the insert pins to insert; wherein further comprising at least one switch component disposed at the external wall of the two supports, a lock element and an elastic element, both ends of the lock element are respectively disposed with a lock catch to lock to the lock groove of the insert pin or release the lock, the switch component drives the lock element to move so as to release the lock; the lock element is repositioned by the elastic element.

The switch component is connected to the lock element in driving way, so that the lock element, when moving axially, releases the lock.

The switch component is connected to the lock element in driving way, so that the lock element, when rotating, releases the lock.

The switch component is a button component, the button component pushes the lock element to move axially directly or by a push block, or the button component pushes a rotation element to rotate by a push block, the rotation element pushes the lock element to move axially.

The switch component is a pull component, the pull component pulls the lock element to move axially directly or by a pull block.

The switch component is a button component, the button component pushes the lock element to rotate directly or by a push block, the lock element is disposed with a wedge block coupled to the button component or the push block to push the lock element to rotate.

An elastic rib with a hook at the end is disposed in the lock element axially at the end aside from the reposition direction, the elastic rib and the hook thereof form a T shape structure; the rotation mechanism is disposed with a first axial insert hole connected to the radial insert hole in the corresponding position, two opposite internal side walls of the first axial insert hole are respectively disposed with a boss to couple to the hook of the elastic rib; the hook of the elastic rib is locked to the boss and inserted into the radial insert hole of the rotation mechanism when the lock element is pushed or pulled, thus forming self-lock; the side wall of the insert pin of the support is disposed with a neck portion to make room for the hook of the elastic rib, with the upper side wall of the neck portion, when the insert pin is disassembled, the hook of the elastic rib leaves away from the boss, so that the lock element is repositioned under the work of the elastic element.

The lock element is disposed with an elastic lock catch at at least one end, the lock element is pushed and self-locked when the elastic lock catches is locked to the insert pin.

The elastic element and the lock element are once forming.

The elastic element and the lock element are separated components.

Each insert pin is disposed with a reducing section with radial size gradually enlarged from up to down to push the lock element to move, the reducing section is disposed above the lock groove.

It further comprises a shaft sleeve with two ends open, the shaft sleeve has two through holes for the insert pins to insert, the rotation mechanism is partially sleeved inside the shaft sleeve, two through holes of the shaft sleeve are respectively coupled to the external sides of the radial insert holes of the rotation mechanism; the lock element is coupled inside the shaft sleeve.

The rotation mechanism includes two rotation components to drive the toilet top cover and the toilet seat to rotate, two rotation components respectively have a said radial insert hole, the lock element is between the two rotation components.

The rotation mechanism includes a rotation component to drive the toilet top cover and the toilet seat to rotate, the rotation component is disposed with two said radial insert holes, the lock element is disposed inside the rotate component.

An implementation method of a quick assembly and disassembly device of a toilet cover, wherein:

providing a lock element, both ends of the lock element are respectively disposed with a lock catch, the lock element moves axially or rotates to drive the lock catch to lock to the lock groove of the insert pin of the support pin or to release the lock;

providing at least one switch component, the switch component is assembled to the external side of the two supports, the switch component drives the lock element to move axially or rotate to release the lock;

providing an elastic element to reposition the lock element.

Another technical proposal of the present invention is that: a quick assembly and disassembly device of a toilet cover, comprising a toilet seat, a toilet top cover, a rotation mechanism and two supports, the two supports are respectively disposed with an insert hole, the rotation mechanism includes a lateral rotation shaft and an insert pin vertical to the lateral direction, the side wall of the insert pin is disposed with a lock groove; further comprising a switch component assembled at the external side of the rotation mechanism and a lock element, the lock element is disposed with a lock catch to lock to the lock groove of the insert pin or release the lock, the switch component drives the lock element to move so as to release the lock.

The quick assembly and disassembly device of a toilet cover further comprise a reposition element, the lock element is repositioned by the reposition element.

In this quick assembly and disassembly device of a toilet cover, the reposition element is a spring.

In the quick assembly and disassembly device of a toilet cover of the present invention and implementation method thereof, with above structure, to assemble the toilet cover, making the radial insert holes of the rotation components aligned to the insert pins of the two supports and pressing them down, the side wall of the reducing section at the top of the insert pin pushes the lock element to move, when the lock groove of each insert pin just moves to be parallel to the two lock catches of the lock element, the lock element is repositioned under the work of the elastic element, so that two lock catches are locked to the lock grooves of the two insert pins, thus finishing the assembly of the toilet cover. To disassemble the toilet cover, operating the switch component to drive the lock element to move to overcome the elastic force of the elastic element, so that two lock catches of the lock element are unlocked to the lock grooves of the two insert pins, thus finishing the disassembly of the toilet cover.

The present invention has following advantages:

1. the present invention is applied with a switch component assembled at a side wall of the toilet cover to work with a lock element and an elastic element thus to realize quick assembly and disassembly of the toilet cover, compared to existing technology of a quick assembly and disassembly device of a toilet cover with one-button or double-button, as the switch component is disposed at the side wall, it is free of dead space in operation, that is to say, the assembly and disassembly is not limited by the opening position of the toilet cover, in addition, the middle portion thereof is once-forming structure, no groove is disposed, making it easy to clean; compared to existing technology of a quick assembly and disassembly device of a toilet cover with double-button and side-press, the present invention has simpler structure, easier operation, more brief and attractive.

2. the present invention further includes a self-lock structure, so that when the toilet cover is to be disassembled, the lock element is self-locked to prevent the switch component from keeping operated, so that it is more easy and convenient to operate.

The present invention will be further described with the drawings and the embodiments; it is appearance that the scope of the present invention of a quick assembly and disassembly device at the side wall of the toilet cover is not limited to the embodiments.

DETAILED DESCRIPTION OF THE EMBODIMENTS

Figure 1:
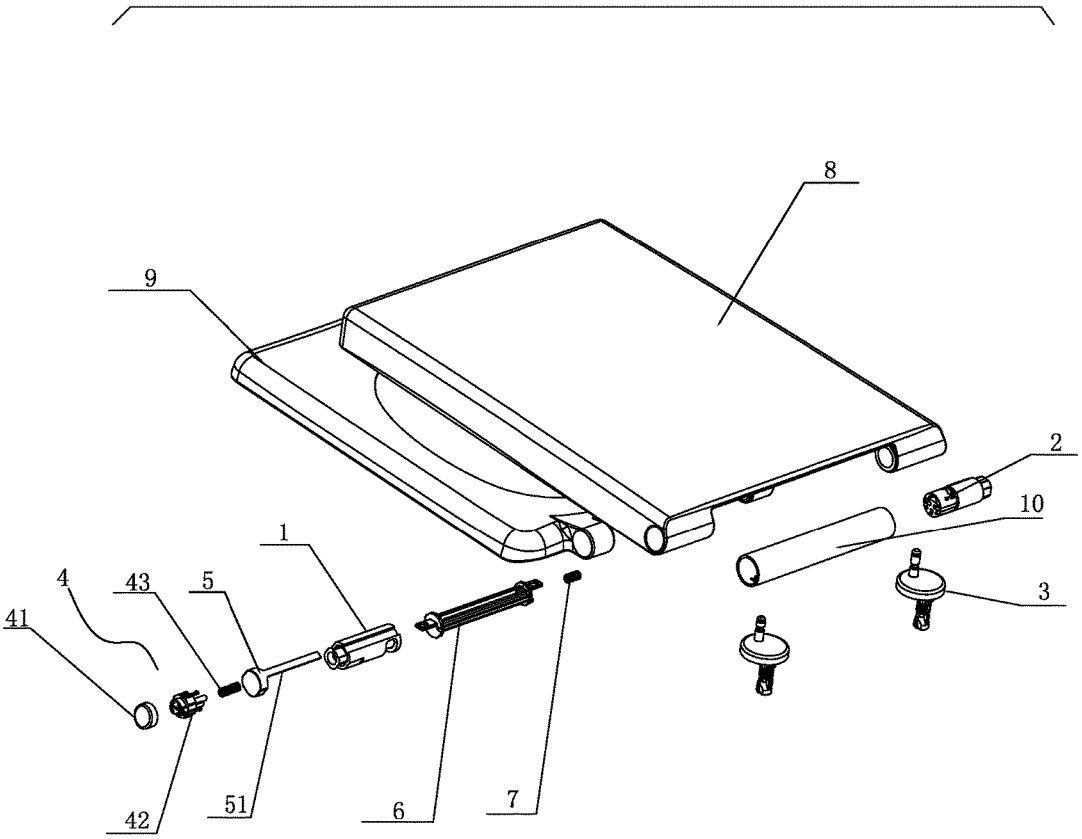
FIG. 1 illustrates an exploded and schematic diagram of a first embodiment of the present invention.
Figure 2:
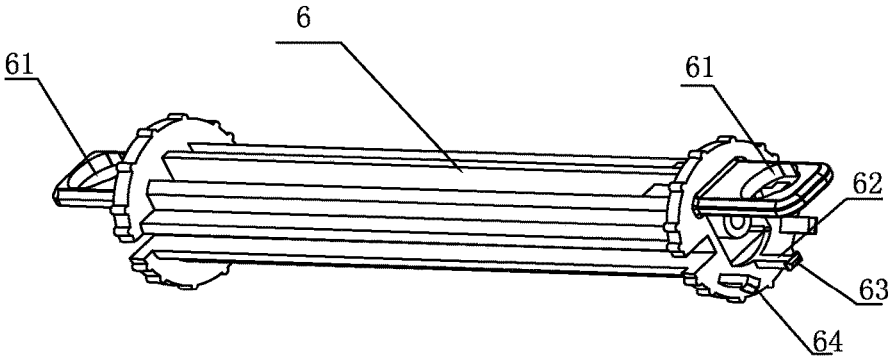
FIG. 2 illustrates a schematic diagram of a lock element of the first embodiment.
Figure 3:
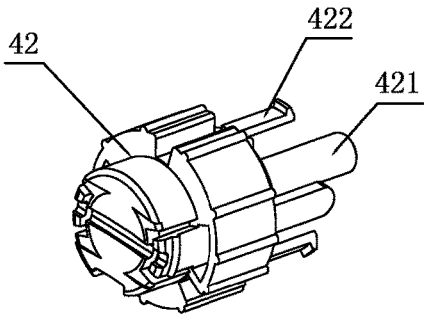
FIG. 3 illustrates a schematic diagram of a button sleeve of the first embodiment.
Figure 4:
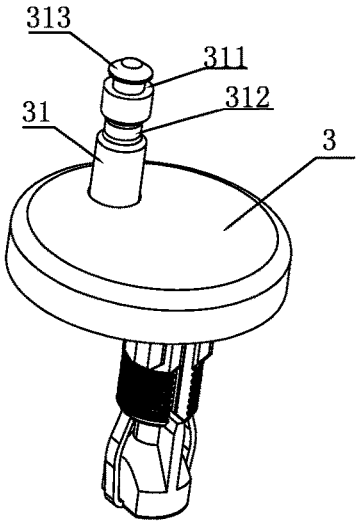
FIG. 4 illustrates a schematic diagram of a support of the first embodiment.
Figure 5:
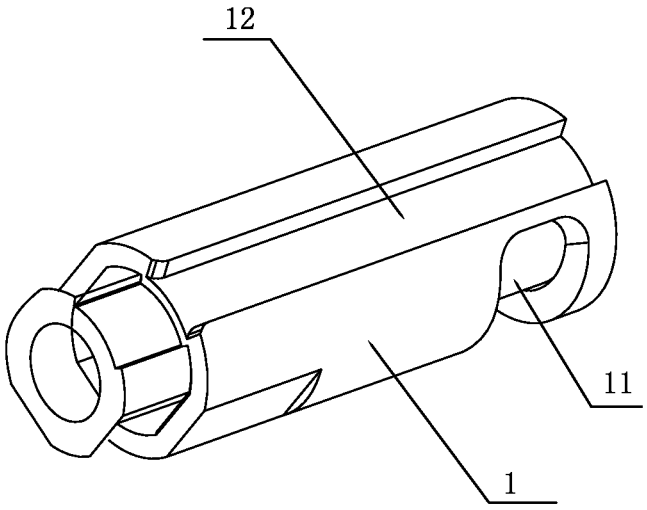
FIG. 5 illustrates a schematic diagram of a left rotation component of the first embodiment.
Figure 6:
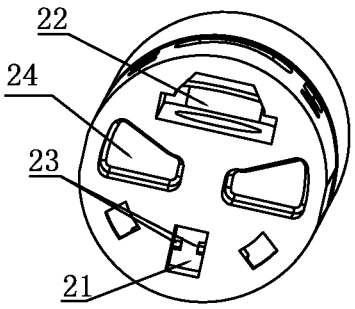
FIG. 6 illustrates a schematic diagram of a right rotation component of the first embodiment.
Figure 7:
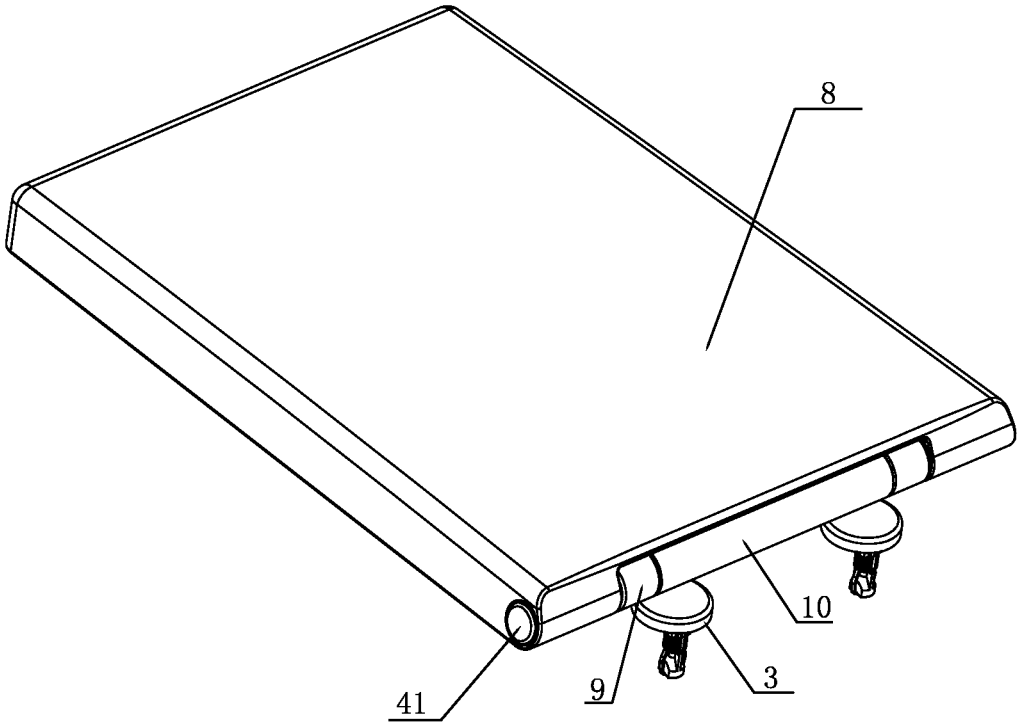
FIG. 7 illustrates a schematic diagram of the first embodiment in assembly state.
Figure 8:
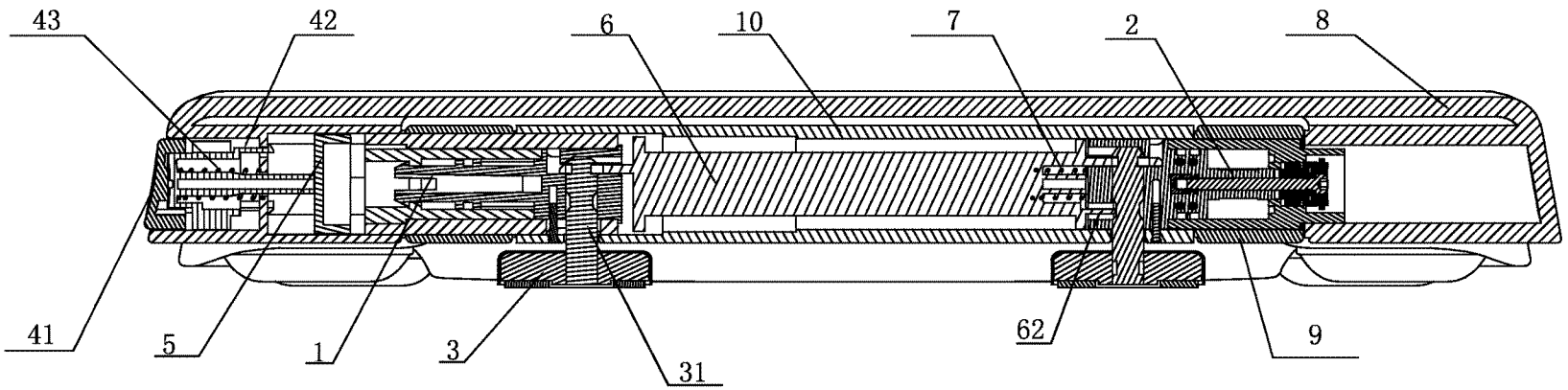
FIG. 8 illustrates a sectional diagram of the first embodiment in assembly condition (the button component is pressed once).

An implementation method of a quick assembly and disassembly device of a toilet cover includes:

providing a lock element, both ends of the lock element are respectively disposed with a lock catch, the lock element moves axially or rotates to drive the lock catch to lock to the lock groove of the insert pin of the support pin or to release the lock;

providing at least one switch component, the switch component is assembled to the external side of the two supports, the switch component drives the lock element to move axially or rotate to release the lock;

providing an elastic element to reposition the lock element.

For above implementation method, the present invention provides several embodiments for further description.

The First Embodiment

Please refer to FIG. 1 to FIG. 6, a quick assembly and disassembly device of a toilet cover of the present invention includes a toilet top cover 8, a toilet seat 9, a rotation mechanism, two supports 3, a switch mechanism, a lock element 6 and an elastic element. Thereinto, the rotation mechanism includes two rotation components to drive the toilet top cover and the toilet seat to rotate (in other cases, of course, there can be disposed with only one rotation component), these two rotation components 1, 2 can be damping mechanisms or non-damping mechanisms, two rotation components 1, 2 are respective disposed with a rotation portion to drive the toilet top cover 8 and the toilet seat 9 to rotate and a non-rotation portion to connect to the supports 3; two supports 3 are fixed to the toilet base, two supports 3 are respectively disposed with an insert pin 31 vertically upward, the side wall at the top portion of each insert pin 31 is disposed with a lock groove 311, the non-rotation portions of the two rotation components 1, 2 are respectively disposed with a radial insert hole for the insert pin to insert (the radial insert hole 11 of the left rotation component 1 is as figured in FIG. 5); the switch component is a button component 4, the button component 4 is assembled to the external side wall of the two supports 3, detailed in the left side wall of the toilet top cover 8; both ends of the lock element 6 are respectively disposed with a lock catch, the lock element can move axially to be between the two rotation components 1, 2, two lock catches of the lock element are respectively inserted into the radial insert holes of the two rotation components so that the lock catches are locked to the lock groove 311 of the insert pin 31 or released the lock; The button component 4 is axially linked to the lock element 6 to push the lock element 6 to move axially to release the lock; the elastic element is a spring 7 (in other cases, the elastic element may not be a spring, the elastic element and the lock element 6 may be once forming), the lock element 6 is repositioned by the spring 7, in detail, the spring 7 abuts between the left end of the lock element 6 and the internal end of the rotation component (that is the right rotation component 2) away from the button component 4.

Preferred, the present invention further comprises a push block 5, the button component 4 is linked axially to the lock element 6 through the push block 5. In detailed, the push block 5 is assembled inside the shaft hole of the toilet top cover 8, one end thereof works with the button component 4, the other end thereof is disposed with a rib 51 along the axial direction, as figured in FIG. 5, the rotation component (that is the left rotation component 1) near to the button component 4 is disposed with a groove 12 with two ends open along the axial direction, the rib 51 of the push block 5 runs through the groove 12 of the left rotation component and abuts against the lock element 6 inside the left rotation component. Hereinto, the left rotation component 1 may be disposed without a groove, it can be that the whole push block 5 wraps partially the left rotation component (wrapping partially is that the push block 5 doesn't wrap the radial insert hole of the left rotation component 1), the internal end of the push block 5 abuts against the lock element 6.

Preferred, one end of the lock element 6 away from the reposition direction (that is the right end of the lock element 6) is disposed with an elastic rib 62 along the axial direction, the end of the elastic rib 62 is disposed with a hook 63, the hook 63 and the elastic rib 62 form a T shape structure, the hook 63 has an inclined surface, the corresponding position of the rotation mechanism, that is the internal end of the rotation component (the right rotation component 2) of the button component 4, is disposed with a first axial insert hole 21 connected to the radial insert hole, the two opposite internal walls of the first axial insert hole 21 are respectively disposed with a boss 23 coupled to the hook 63 of the elastic rib 62, the push work of the button component 4 to the lock element 6 makes the hook 63 of the elastic rib 62 hooked to the two bosses 23 and inserted into the radial insert hole of the left rotation component 2, thus forming a self-lock; in the support 3 away from the button component 4 (that is the right support 3), the side wall of the insert pin 31 is disposed with a neck portion 312 to make room for the hook of the elastic rib 62, the up and down side walls of the neck portion 312 are arc surfaces, when the insert pin 31 is disassembled, the up side wall of the neck portion 312 works to separate the hook 62 of the elastic rib from the boss, so that the lock element 6 is repositioned under the work of the spring 7.

Preferred, said button component 4 includes a button 41, a button cover 42 and a reposition spring 43 (of course that the button component 4 can be disposed without a reposition spring but repositioned with the lock element 6), the button 41 is fixed to the button cover 42 and assembled to the external section of the shaft hole of the toilet top cover 8; the internal surface of the button cover 42 is disposed with a column 421 to push the push block 5 to move and two first jaws 422 to hook to the shaft hole of the toilet top cover 8 to position; the button 41 and the button cover 42 are repositioned by the reposition spring 43, the reposition spring 43 abuts between the button cover 42 and the internal side of the shaft hole of the toilet top cover 8. Hereinto, the reposition spring 43 can be applied with following three other methods to assemble: the reposition spring 43 abuts between the push block 5 and the internal side of the shaft hole of the toilet top cover 8; the reposition spring 43 abuts between the push block 5 and the internal side of the shaft hole of the seat 9; the reposition spring 43 abuts between the push block 5 and the rotation component near to the button component 4 (the left rotation component 1).

Preferred, the opposite internal end of the two rotation components 1, 2 are respectively disposed with a second axial insert hole connected to the radial insert hole (as the FIG. 6 figured with a second axial insert hole 22 of the right rotation component 2), two lock catches of the lock element 6 are respectively inserted into the radial insert holes of the two rotation components 1, 2. Besides, for the two lock catches of the lock element 6 to get into the radial insert holes of the two rotation components 1, 2 respectively, it can be applied with following method: the side wall of the two rotation components 1, 2 are respectively disposed with a bar through hole connected to the radial insert hole, two ends of the lock element 6 are Z shaped, so that the two lock catches of the lock element 6 can get into the radial insert hole of the rotation component through corresponding bar through hole. The right end of the lock element 6 is disposed with two second jaws 64 to position, correspondingly, the internal end of the right rotation component is disposed with two third axial insert holes 24, two second jaws 64 of the lock element 6 insert into corresponding third axial insert hole 24 and hook to the internal side.

Preferred, two lock catches of the lock element 6 are respectively flat holes 61 extending along the axial direction, the curvature radius of the left side of the flat hole 61 is larger than that of the right side. Besides, two lock catches of the lock element 6 can be that: the lock catch near to the button component 4 is a lock catch groove, the lock catch away from the button component 4 is a flat hole.

Preferred, the top portion of each insert pin 31 is disposed with a reducing section 313 with radial size gradually enlarged from up to down to make the side wall being an inclined surface, the reducing section 313 is disposed above the lock groove 311 to push the lock element 6 to move a bit.

Preferred, the present invention further includes a shaft sleeve 10 with two ends open, the left and right ends of the shaft sleeve 10 are respectively disposed with through hole for the insert pin 31 to insert, the two ends of the shaft sleeve 10 are respectively sleeve on the non-rotation portions of the two rotation component, the through holes of the shaft sleeve 10 are respectively coupled to the corresponding external side of the radial insert hole of the rotation component. The lock element 6 is covered inside the shaft sleeve 10.

The assembly progress of the quick assembly and disassembly device of a toilet cover of the present invention is that: making the radial insert holes of the two rotation components 1, 2 aligned to the insert pins 31 of the two supports and pressing them down, the inclined surface at the top of the two insert pins 31 presses the hole wall of the two flat holes 61 of the lock element 6, so that the lock element 6 overcomes the elastic force of the spring 7 and moves right a bit to make room for the two insert pins 31; keeping on pressing down, the lock groove 311 of each insert pin 31 moves to be parallel to the two flat holes 61 of the lock element 6 exactly, the lock element 6 is repositioned under the work of the spring 7, so that two flat holes 61 are respectively locked to the lock grooves 311 of the two insert pins 31, thus implementing the assembly of the toilet cover.

The disassembly progress is that: pressing the button 41 at the left side of the toilet top cover 8, making the reposition spring 43 compressed, then the button cover 42 and the push block 5 push the lock element 6 to move right axially, the lock element 6 compresses the spring 7, so that two flat holes 61 respectively leaves away from the lock grooves 311 of the two insert pins 31, and the hook 63 at the end of the elastic rib 62 of the lock element 6 hooks to the boss 23 of the rotation component and gets into the radial insert hole of the rotation component, thus forming a self-lock, preventing the lock element 6, after the button 41 is released from press, being repositioned under the work of the spring 7; lifting the toilet cover up, making two insert pins 31 respectively escaped from the radial insert holes of the two rotation components 1, 2, when the rotation components moves with respect to the insert pin 31, the upper side wall of the neck portion 312 of the insert pin 31 makes the hook 63 of the elastic rib of the lock element 6 escaped from the boss of the right rotation component, thus the lock element releases the lock and is repositioned under the work of the spring 7 for next assembly.

The Second Embodiment

Figure 9:
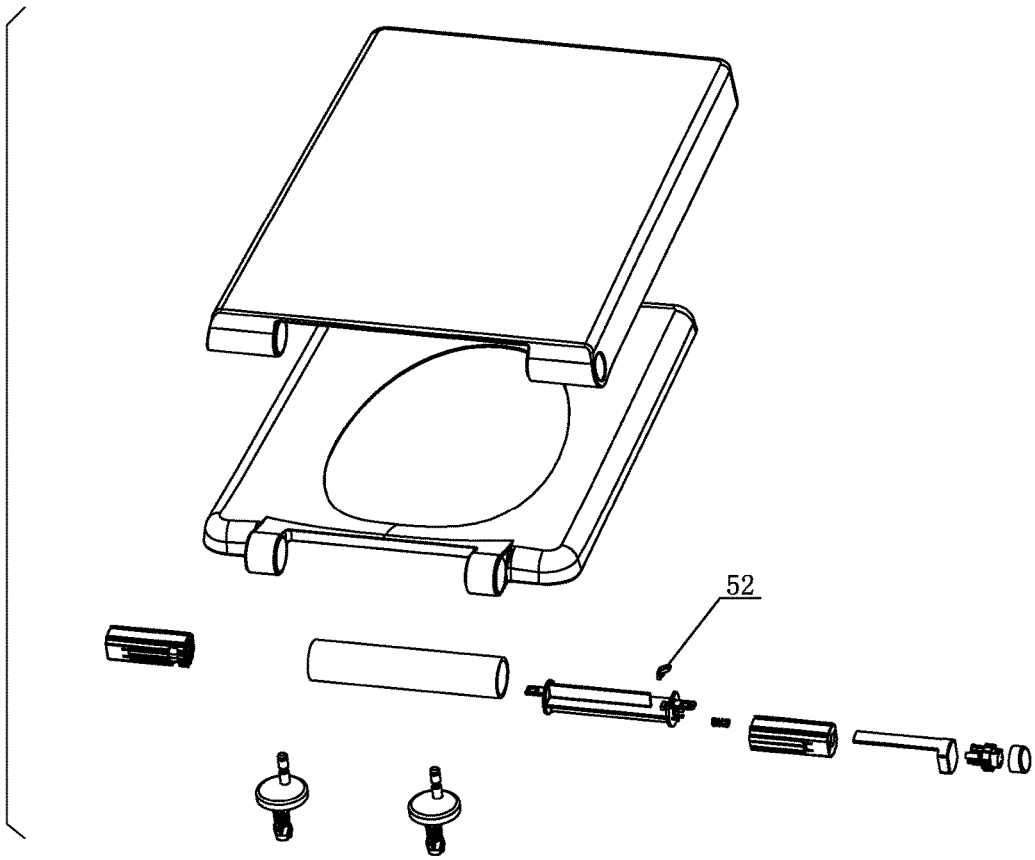
FIG. 9 illustrates an exploded and schematic diagram of a second embodiment of the preset invention.
Figure 10:
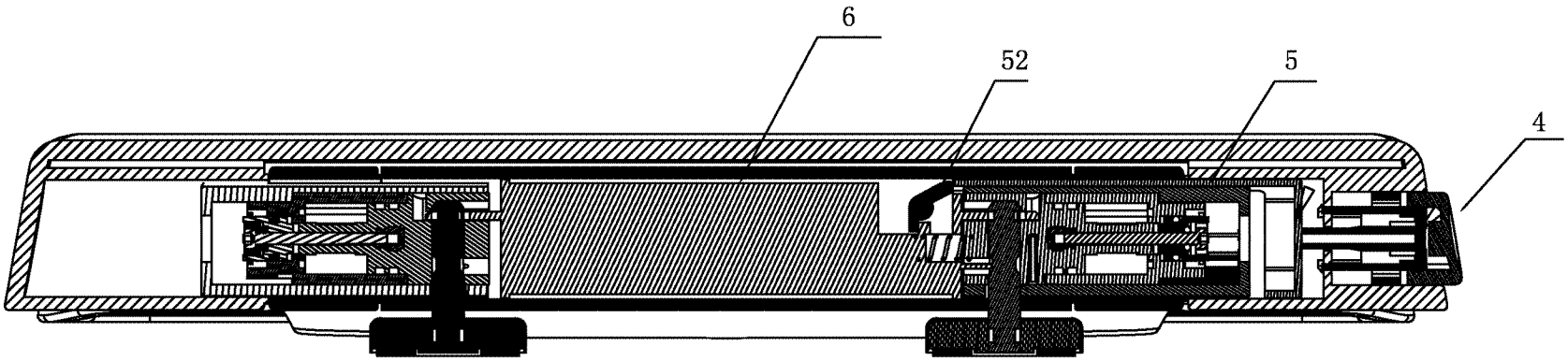
FIG. 10 illustrates a sectional diagram of the second embodiment in assembly condition (the button component is pressed once).

Please refer to FIG. 9 and FIG. 10, a quick assembly and disassembly device of a toilet cover of the present invention differs from the first embodiment that: it further includes a rotation body 52 rotationally assembled, the button component 4 pushes the rotation body 52 to rotate by a push block 5, the rotation body 52 rotates to push the lock element 6 to move axially.

The assembly and disassembly progress of this embodiment are similar with the first embodiment.

The Third Embodiment

Figure 11:
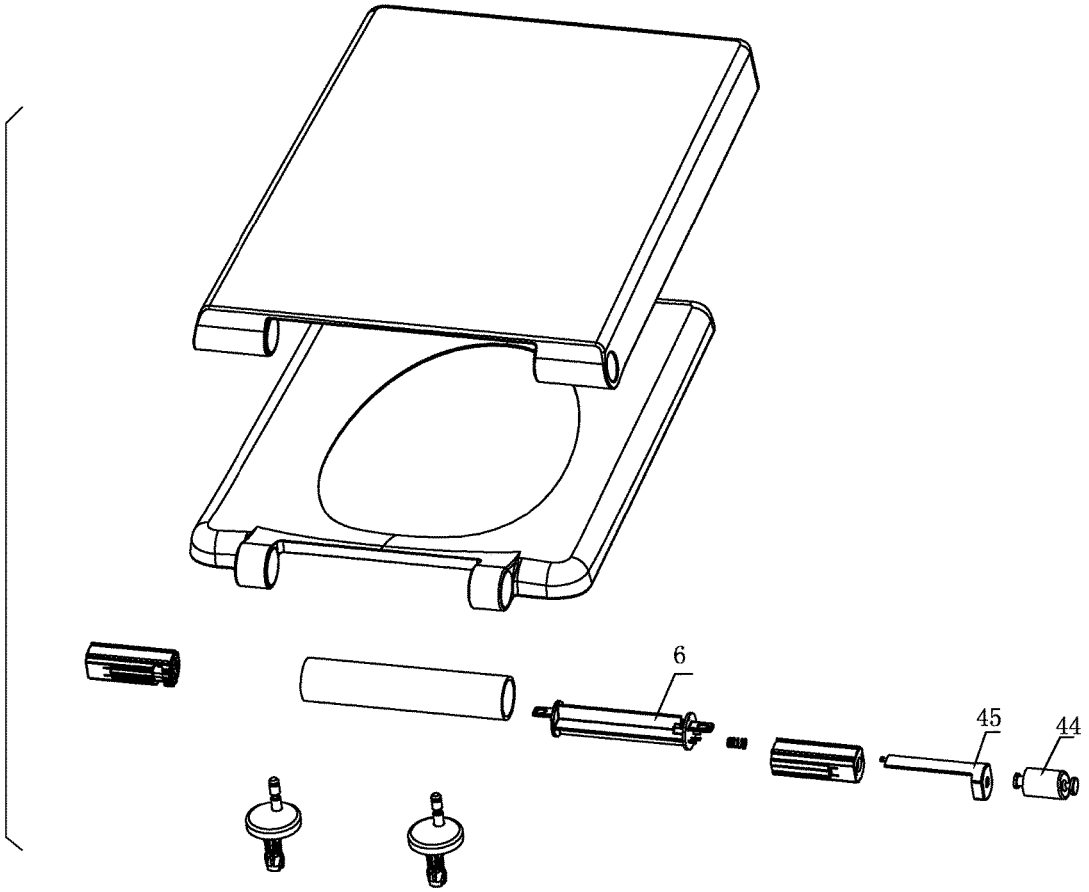
FIG. 11 illustrates an exploded and schematic diagram of a third embodiment of the present invention.
Figure 12:
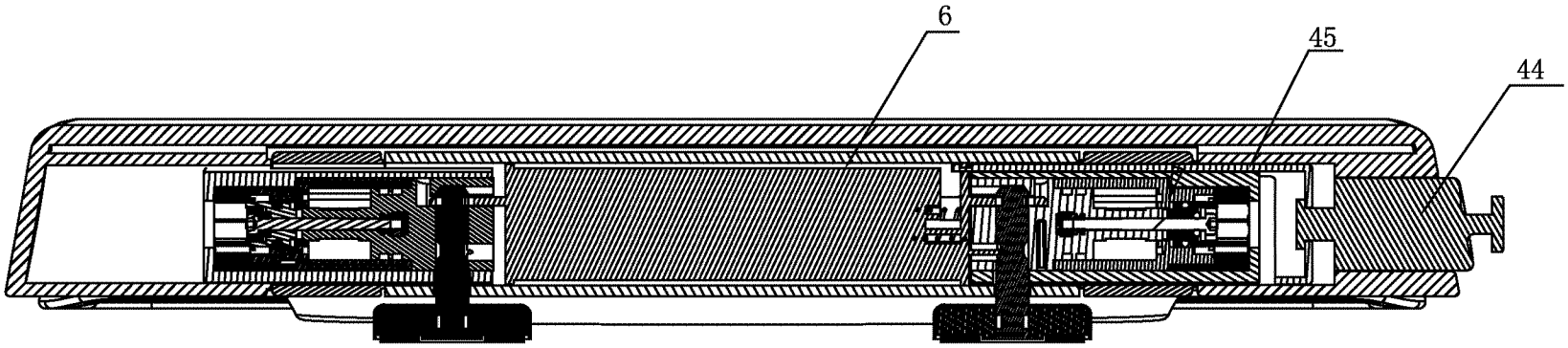
FIG. 12 illustrates a sectional diagram of the third embodiment in assembly condition (the pull component is pressed once).
Figure 13:
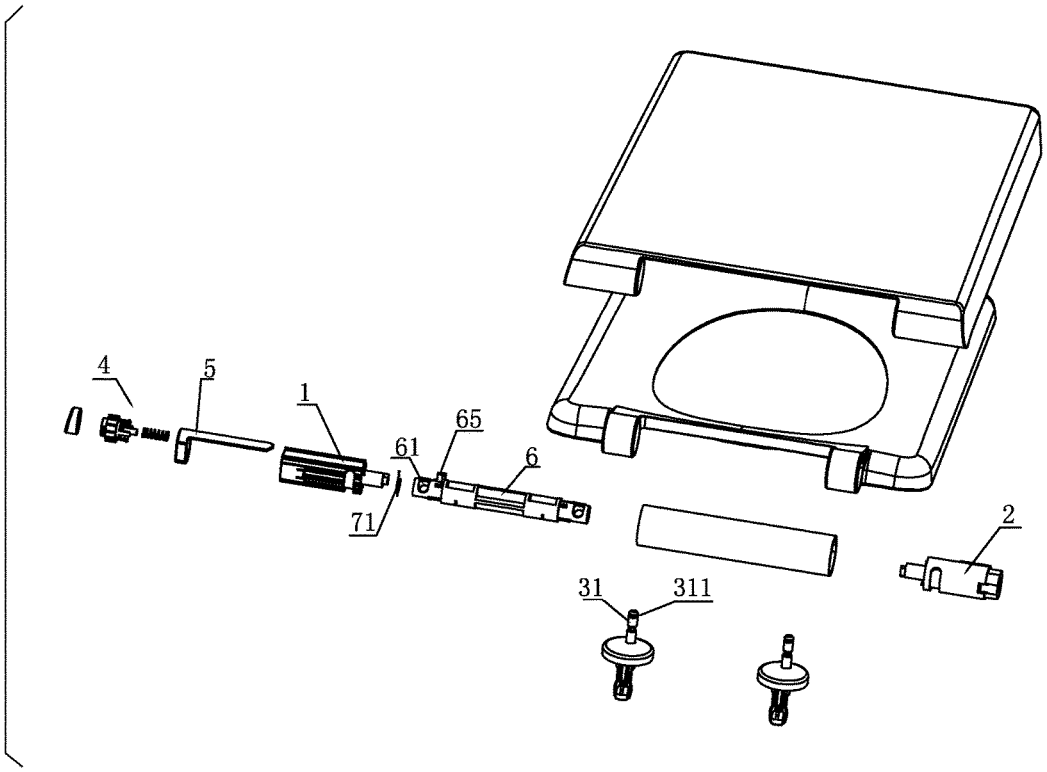
FIG. 13 illustrates an exploded and schematic diagram of a fourth embodiment of the present invention.
Figure 14:
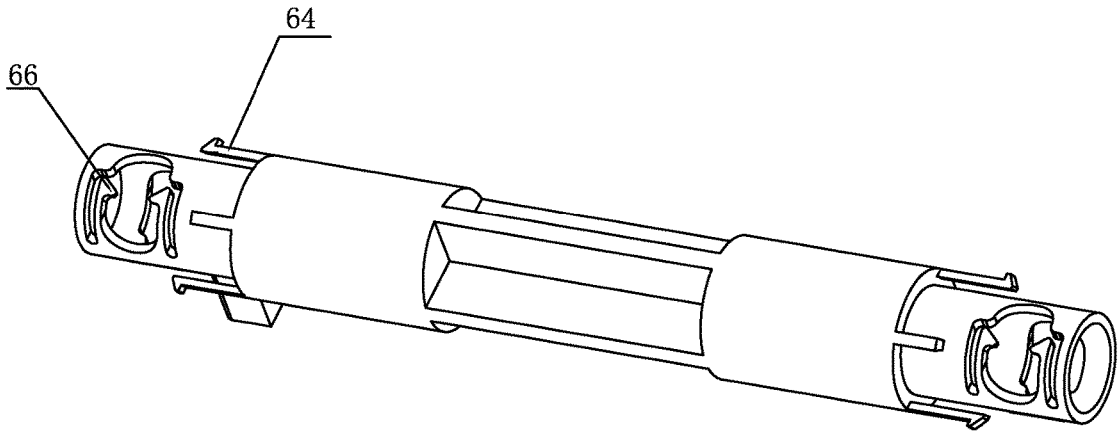
FIG. 14 illustrates a schematic diagram of a lock element of the fourth embodiment.
Figure 15:
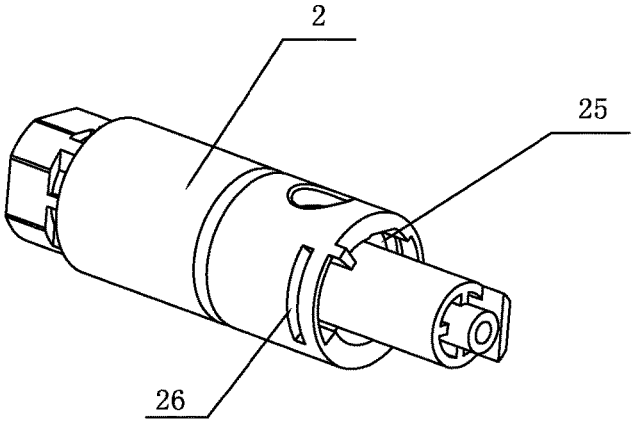
FIG. 15 illustrates a schematic diagram of a right rotation component of the fourth embodiment.
Figure 16:
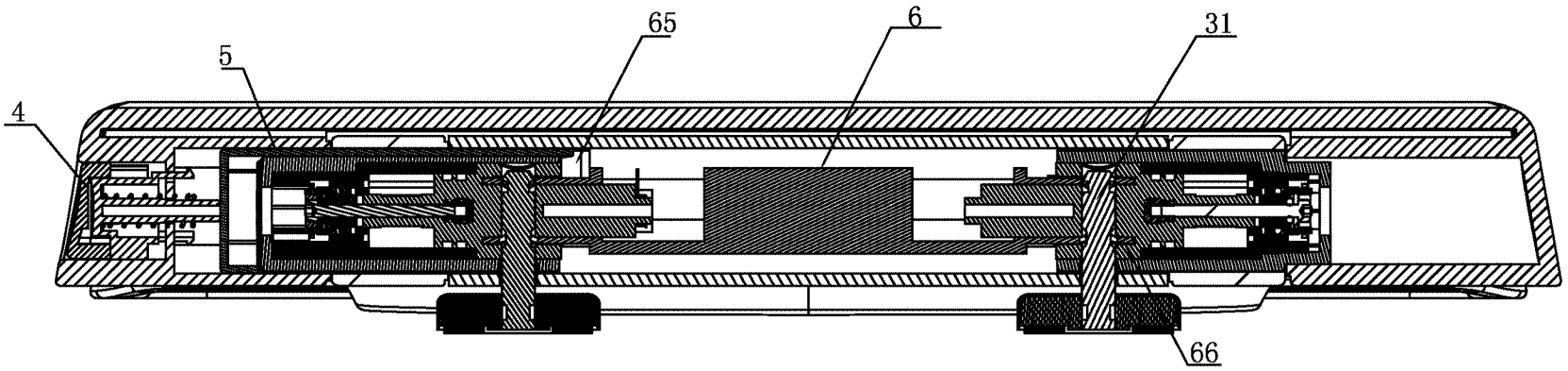
FIG. 16 illustrates a sectional diagram of the fourth embodiment in assembly condition.

Please refer to FIG. 11 and FIG. 12, a quick assembly and disassembly device of a toilet cover of the present invention differs from the first embodiment and the second embodiment that: the switch component is a pull component 44, the pull component 44 pulls the lock element 6 to move axially by a pull block 45 connected to the lock element 6.

The assembly and disassembly progress of this embodiment are similar with the first embodiment, and to quick disassemble, just changing pressing the button component 4 in the first embodiment to pulling the pull component 44.

The Fourth Embodiment

Please refer to FIG. 13 to FIG. 16, a quick assembly and disassembly device of a toilet cover of the present invention differs from the first embodiment that: the lock element 6 rotates to make the lock catches locked to the lock grooves 311 of the insert pins or release the lock. In detailed, the lock catches 61 at the two ends of the lock element are flat holes extending peripherally, the curvature radius of the rear side of the flat holes is smaller than that of the front side; the end of the lock element 6 near to the button component 4 is disposed with a wedge block 65, the end of the push block 5 and the wedge block 65 work to push the lock element 6 to rotate; the elastic body is a torsion spring 71. to assemble quickly, the button component 4 pushes the wedge block 65 to drive the lock element 6 to rotate by the push block 5, so that the portion of the flat holes at two ends of the lock element 6 with smaller curvature radius leaves away from the lock grooves 311 of the insert pins to release the lock. To disassemble quickly, the lock element 6 rotates reversely under the work of the torsion spring 71, so that the portion of the flat holes at two ends of the lock element 6 with smaller curvature radius locks to the lock grooves 311 of the insert pins.

Besides, in the quick assembly and disassembly device of a toilet cover of the present invention, to self-lock, two elastic lock catches 66 are respectively disposed below the corresponding lock catch 61 of the lock element to hold the insert pins 31 to make the lock element 6 self-locked. That is to say, to disassemble, pressing the button component 4 once, the lock element 6 rotates to make the portion of the flat holes at two ends of the lock element 6 with smaller curvature radius left away from the lock grooves 311 of the insert pins to release the lock, and two elastic lock catches 66 of the lock element hold the insert pins tightly to prevent the lock element from rotating reversely under the work of the torsion spring 71. during the insert pins 31 leaving the radial insert holes of the rotation component, with the radial movement of the insert pins 311, two elastic lock catches 66 respectively leaves away from the insert pins as with their elastic performance, so that the lock element 6 repositions under the work of the torsion spring 71.

Besides, a quick assembly and disassembly device of a toilet cover of the present invention differs from the first embodiment that: the opposite internal sides of the two rotation components 1, 2 are respectively disposed with a ring-shape radial insert hole 25 for the two ends of the lock element 6 to insert (as figured in FIG. 15), two ends of the lock element 6 are sleeve shaped, the lock catches 61 are disposed at the upper side wall of the sleeve structure, the elastic lock catches 66 are disposed at the lower side wall of the sleeve structure; for assembly and positioning, two ends of the lock element 6 are disposed with two second jaws 64 similarly, the side wall of the opposite internal ends of the rotation components 1, 2 are respectively disposed with bar hole 26 extending peripherally for the ends of the two second jaws 64 of the lock element hooked to the bar hole 26 and moved with the rotation of the lock element at the specific area of the bar holes 26.

The Fifth Embodiment

Figure 17:
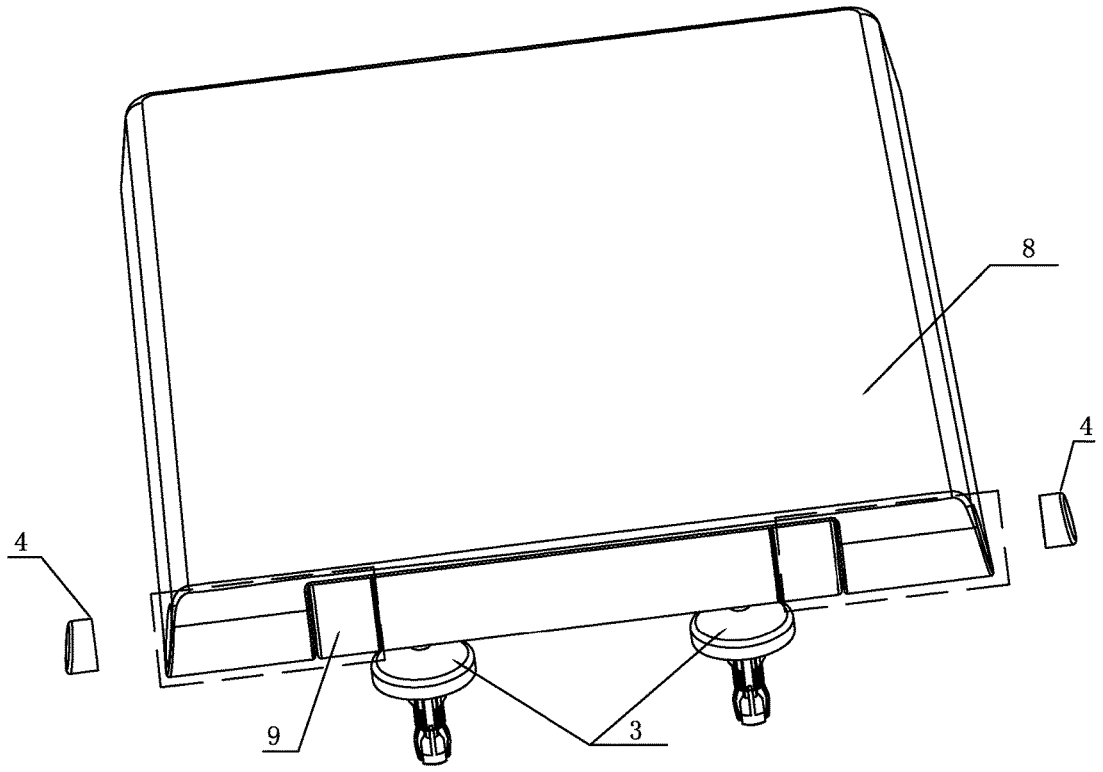
FIG. 17 illustrates a schematic diagram of a fifth embodiment of the present invention (the button component is pressed once).
Figure 18:
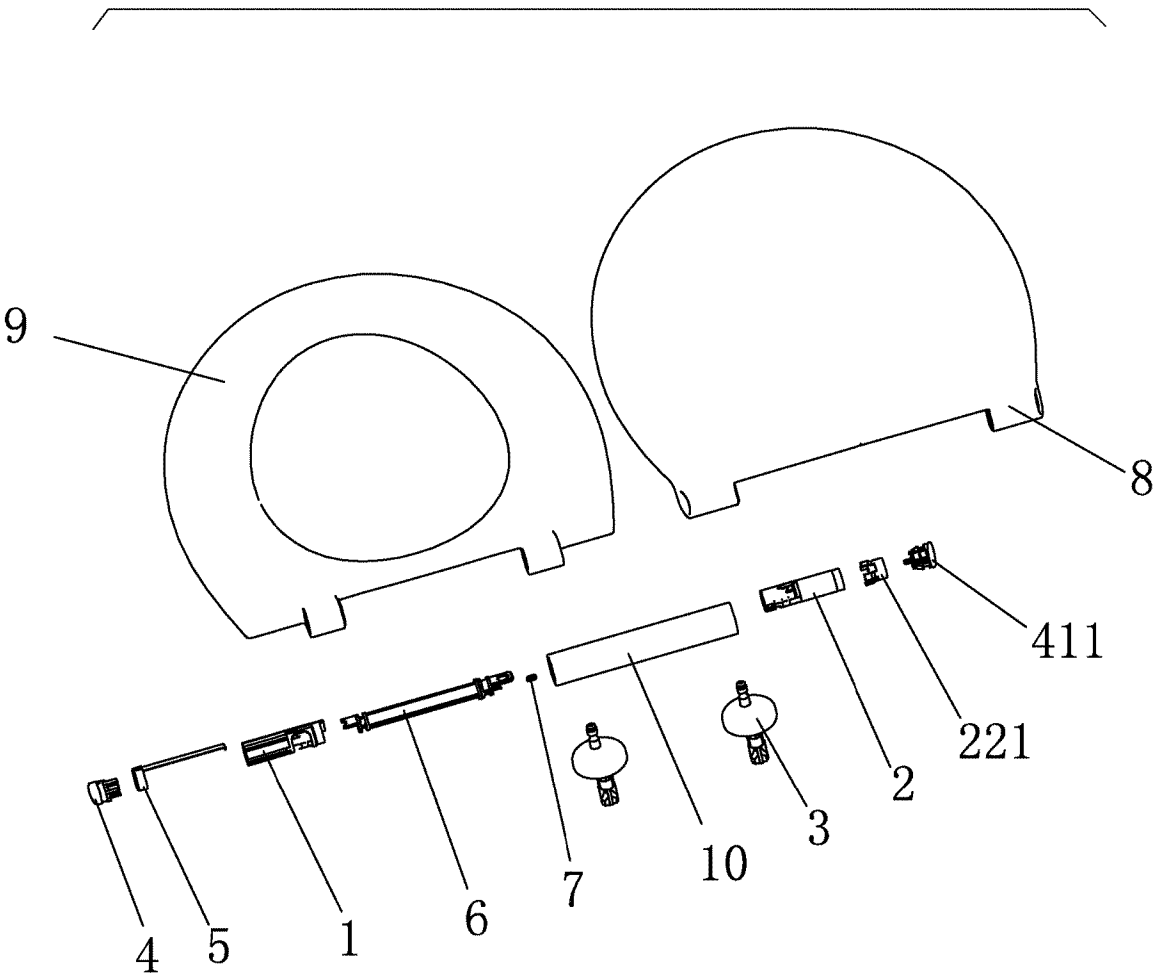
FIG. 18 illustrates an exploded and schematic diagram of a sixth embodiment of the present invention.
Figure 19:
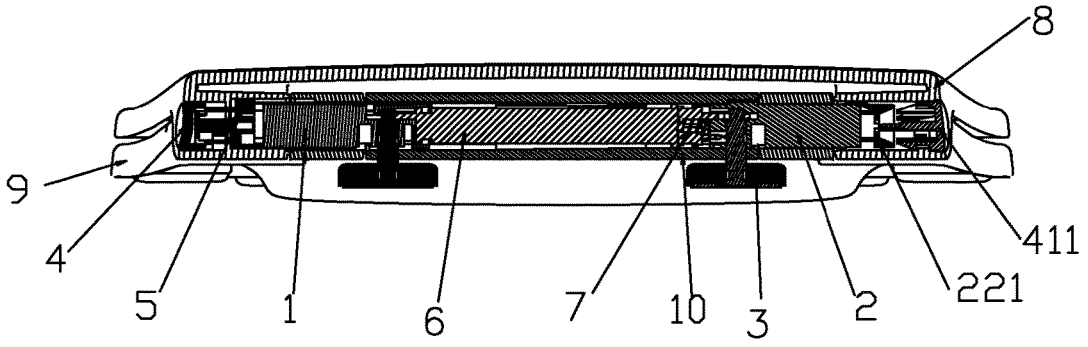
FIG. 19 illustrates a sectional diagram of the sixth embodiment in assembly condition.

As figured in FIG. 17, a quick assembly and disassembly device of a toilet cover of the present invention differs from the first embodiment that: there are two switch components, the button components 4, respectively assembled to the external side wall of the two supports 3, two dotted box in FIG. 17 are respectively the assembly area of the button components 4, that is to say, two button components 4 are respectively assembled to the right side and left side of the toilet top cover 8, or to the right side and left side of the toilet seat 9, when assembled to the left side and right side of the toilet seat 9, just making the shaft sleeve (for assembling the rotation component) of the toilet seat 9 at the external side of the shaft sleeve (for assembling the rotation component) of the toilet top cover 8. In addition, operating any button component 4 can realize the quick assembly and disassembly of the toilet cover.

In the same way, when the switch components are pull components 44 like the third embodiment or other operation component, there can be two switch components, the assembly positions are as above.

The Sixth Embodiment

A quick assembly and disassembly device of a toilet cover of the present invention differs from the first embodiment that: please refer to FIG. 18 to FIG. 25, this embodiment includes a decorate cover 411, a support sleeve 221, the switch component of this embodiment is disposed at the left side of the rotation shaft of the cover, the decorate cover 411 is disposed at the right end of the rotation shaft of the cover, a boss 81 is disposed inside the rotation shaft hole of the top cover, one end of the decorate cover 411 in the axial direction is a decorate surface, the other end extends with a rib 4111 and the lock catch 4112 in the axial direction, the lock catch 4112 of the cover and the boss 81 of the top cover work to limit the decorate cover inside the shaft hole of the top cover 8. The support sleeve 221 is disposed between the decorate cover 411 and the right rotation component 2, the main body is a sleeve pipe, inside the pipe is disposed with an inclined surface 2211 along the axis, a first groove 2213 is further disposed for the rib 4111 of the decorate cover to run through, so that only when the rib 4111 of the decorate cover and the first groove 2213 align, the support sleeve 221 moves to the axis, the decorate cover has well position work inside the rotation shaft hole.

Figure 20:
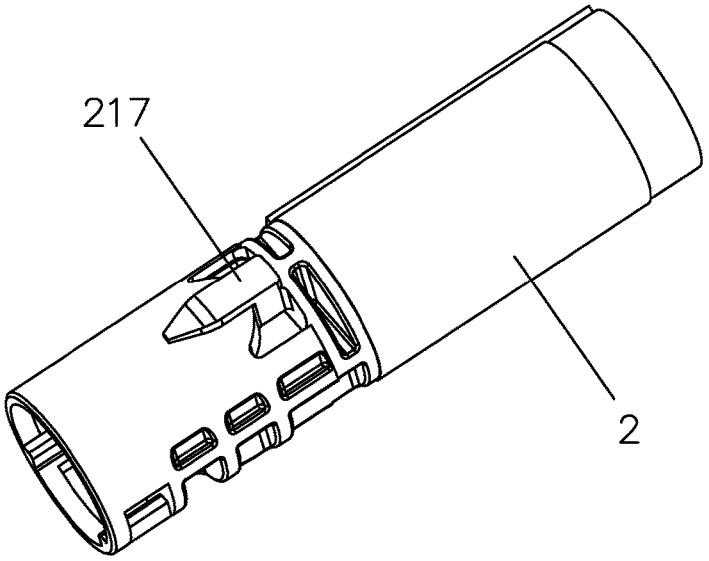
FIG. 20 illustrates a schematic diagram of a right rotation component of the sixth embodiment.
Figure 21:
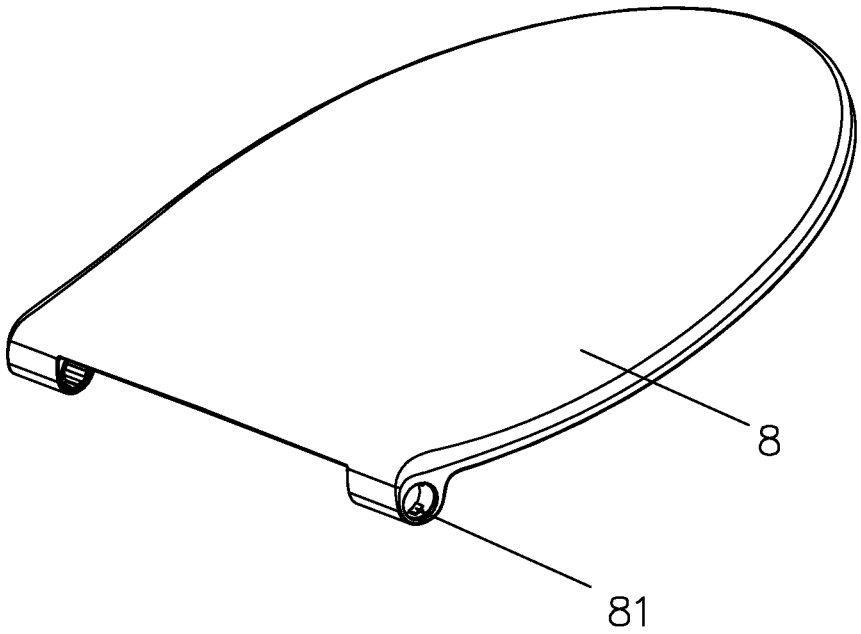
FIG. 21 illustrates a schematic diagram of a cover of the sixth embodiment.
Figure 22:
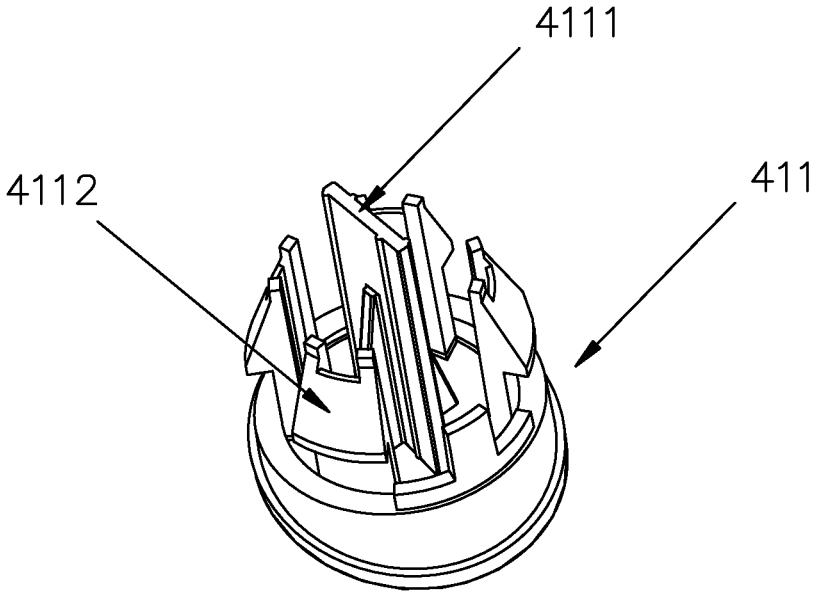
FIG. 22 illustrates a schematic diagram of a decorate cover of the sixth embodiment.
Figure 23:
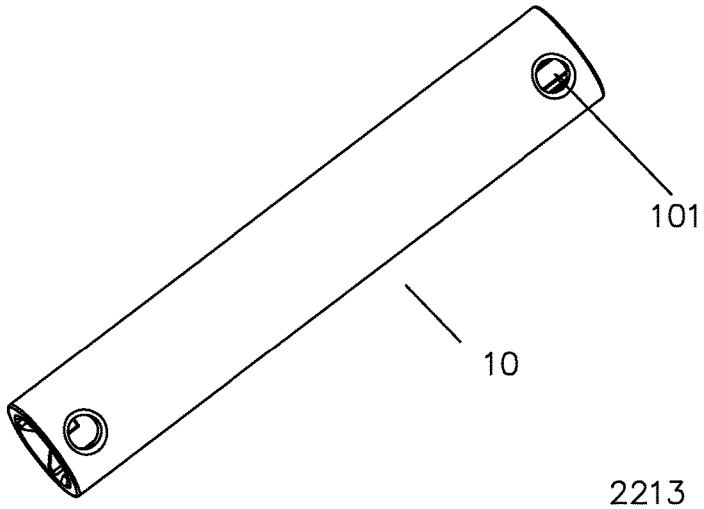
FIG. 23 illustrates a schematic diagram of a sleeve pipe of the sixth embodiment.
Figure 24:
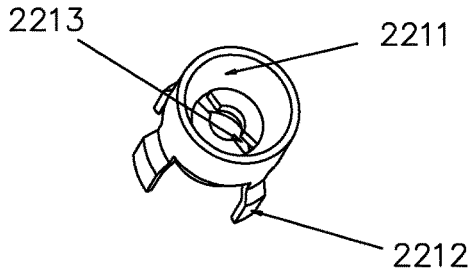
FIG. 24 illustrates a schematic diagram of a support sleeve of the sixth embodiment.
Figure 25:
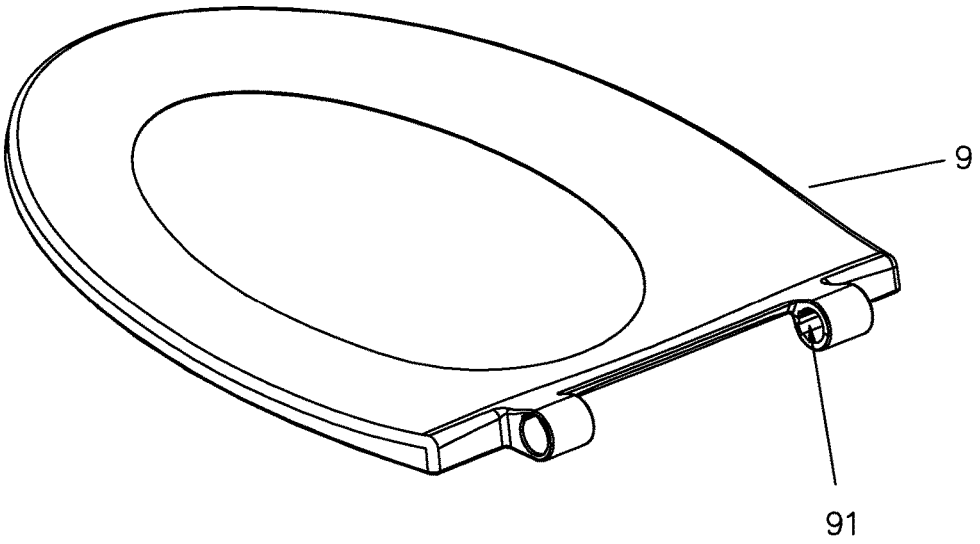
FIG. 25 illustrates a schematic diagram of a seat of the sixth embodiment.

The right rotation component can be a damper or just a rotation shaft, as figured in FIG. 20, an disassembly rib 217 is disposed in the periphery of the right rotation component, a second groove 91 is disposed inside the shaft hole of the seat 9 correspondingly, when the disassembly rib 217 is positioned in the second groove, the right rotation component moves to the right side of the rotation shaft of the cover.

To disassemble the quick assembly and disassembly device of this embodiment, lifting the cover to a certain angle, removing the cover, in this position, the rib 4111 of the decorate cover is aligned to the first groove 2213 of the support sleeve, the insert pin hole 101 of the sleeve pipe pushes the right rotation component 2 to make the support sleeve 221 moved right, the inclined surface 2211 at the internal side of the support sleeve presses the lock catch 4112 of the decorate cover to move back and deform in along the axis to leave away from the boss 81 of the top cover, so that the components of the quick assembly and disassembly device are removed from the shaft hole of the cover thus to repair or exchange.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided to quick assemble a toilet cover with single-button side-press switch component, and the quick assembly device is easy to disassemble.

The invention claimed is:

1. A quick assembly and disassembly device of a toilet cover, comprising
- a toilet seat,
- a toilet top cover,
- a rotation mechanism and
- two supports, the two supports each respectively provided with an insert pin,
- each said insert pin provided with a lock groove at a side wall of a top portion,
- the rotation mechanism is disposed with two radial insert holes for the insert pins to be inserted into;
- further comprising at least one switch component disposed at an external wall of the two supports, a lock element and an elastic element,
- both ends of the lock element are respectively disposed with a lock catch to lock to the lock groove of the insert pin or release the lock,
- the switch component drives the lock element to move so as to release the lock;
- the lock element is repositioned by the elastic element, wherein
- the switch component is a button component disposed only at one side of the rotation mechanism,
- the button component pushes the lock element to move axially directly or by a push block including a push rod,
- the rotation mechanism is provided with a longitudinal groove in an outer face thereof, and
- the push rod is configured to move in the longitudinal groove.

2. The quick assembly and disassembly device of a toilet cover according to claim 1, wherein the switch component is connected to the lock element in driving way, so that the lock element, when moving axially, releases the lock.

3. The quick assembly and disassembly device of a toilet cover according to claim 2, wherein
- an elastic rib with a hook at the end is disposed in the lock element axially at the end aside from the reposition direction,
- the elastic rib and the hook thereof form a T shape structure;
- the rotation mechanism is disposed with a first axial insert hole connected to the radial insert hole in the corresponding position,
- two opposite internal side walls of the first axial insert hole are respectively disposed with a boss to couple to the hook of the elastic rib;
- the hook of the elastic rib is locked to the boss and inserted into the radial insert hole of the rotation mechanism when the lock element is pushed or pulled, thus forming self-lock; the side wall of the insert pin of the support is disposed with a neck portion to make room for the hook of the elastic rib, with the upper side wall of the neck portion, when the insert pin is disassembled, the hook of the elastic rib leaves away from the boss, so that the lock element is repositioned under the work of the elastic element.

4. The quick assembly and disassembly device of a toilet cover according to claim 1, wherein the switch component is connected to the lock element in driving way, so that the lock element, when rotating, releases the lock.

5. The quick assembly and disassembly device of a toilet cover according to claim 4, wherein the lock element is disposed with an elastic lock catch at at least one end, the lock element is pushed and self-locked when the elastic lock catches is locked to the insert pin.

6. The quick assembly and disassembly device of a toilet cover according to claim 1, wherein the elastic element and the lock element are once forming.

7. The quick assembly and disassembly device of a toilet cover according to claim 1, wherein the elastic element and the lock element are separated components.

8. The quick assembly and disassembly device of a toilet cover according to claim 1, wherein each insert pin is disposed with a reducing section with radial size gradually enlarged from up to down to push the lock element to move, the reducing section is disposed above the lock groove.

9. The quick assembly and disassembly device of a toilet cover according to claim 1, wherein further comprising a shaft sleeve with two ends open, the shaft sleeve has two through holes for the insert pins to insert, the rotation mechanism is partially sleeved inside the shaft sleeve, two through holes of the shaft sleeve are respectively coupled to the external sides of the radial insert holes of the rotation mechanism;

the lock element is coupled inside the shaft sleeve.

10. The quick assembly and disassembly device of a toilet cover according to claim 1, wherein the rotation mechanism includes two rotation components to drive the toilet top cover and the toilet seat to rotate, two rotation components respectively have a said radial insert hole, the lock element is between the two rotation components.

11. The quick assembly and disassembly device of a toilet cover according to claim 1, wherein the rotation mechanism includes a rotation component to drive the toilet top cover and the toilet seat to rotate, the rotation component is disposed with two said radial insert holes, the lock element is disposed inside the rotate component.

12. The quick assembly and disassembly device of a toilet cover according to claim 1, wherein further comprising a quick disassembly device, the quick assembly device comprises a decorate cover and a support sleeve, the switch component of the cover is disposed at the left end of a rotation shaft of the cover, the decorate cover is disposed at the right end of the rotation shaft of the cover, a boss is disposed inside the shaft hole of the top cover, one end of the decorate cover extends axially with a lock catch, the lock catch of the decorate cover and the boss of the top cover cooperate to limit the decorate cover inside the shaft hole of the top cover;

the support sleeve is disposed at the internal side of the decorate cover, the inside of the support sleeve is an inclined surface along the axis, the support sleeve moves to one side of the decorate cover, the inclined surface of the inside of the support sleeve abuts the lock catch of the decorate cover to move back and deform along the axis, thus escaping from the boss of the top cover.

13. The quick assembly and disassembly device of a toilet cover according to claim 12, wherein the decorate cover further includes a rib, the support sleeve further includes a first groove, the rib runs through the first groove, when the rib of the decorate cover is coupled to the first groove, the support sleeve moves to the left side.

14. The quick assembly and disassembly device of a toilet cover according to claim 13, wherein the external periphery of the right rotation component is disposed with a disassembly rib, a second groove is disposed inside the shaft hole of the seat corresponding to the disassembly rib, in the position of the disassembly rib corresponding to the second groove, the right rotation component moves to the right side of the rotation shaft of the cover.

15. The quick assembly and disassembly device of a toilet cover according to claim 12, wherein the external periphery of the right rotation component is disposed with a disassembly rib, a second groove is disposed inside the shaft hole of the seat corresponding to the disassembly rib, in the position of the disassembly rib corresponding to the second groove, the right rotation component moves to the right side of the rotation shaft of the cover.

16. The quick assembly and disassembly device of a toilet cover according to claim 1, wherein an elastic rib with a hook at the end is disposed in the lock element axially at the end aside from the reposition direction, the elastic rib and the hook thereof form a T shape structure;

the rotation mechanism is disposed with a first axial insert hole connected to the radial insert hole in the corresponding position, two opposite internal side walls of the first axial insert hole are respectively disposed with a boss to couple to the hook of the elastic rib;

the hook of the elastic rib is locked to the boss and inserted into the radial insert hole of the rotation mechanism when the lock element is pushed or pulled, thus forming self-lock;

the side wall of the insert pin of the support is disposed with a neck portion to make room for the hook of the elastic rib, with the upper side wall of the neck portion, when the insert pin is disassembled, the hook of the elastic rib leaves away from the boss, so that the lock element is repositioned under the work of the elastic element.

17. The quick assembly and disassembly device of a toilet cover according to claim 1, wherein the lock element is disposed with an elastic lock catch at at least one end, the lock element is pushed and self-locked when the elastic lock catches is locked to the insert pin.

18. A quick assembly and disassembly device of a toilet cover, comprising a toilet seat, a toilet top cover, a rotation mechanism and two supports, the two supports are each respectively provided with an insert hole, the rotation mechanism includes a lateral rotation shaft and an insert pin vertical to the lateral direction, a side wall of the insert pin is disposed with a lock groove;

further comprising a switch component assembled at the external side of the rotation mechanism and a lock element, the lock element is disposed with a lock catch to lock to the lock groove of the insert pin or release the lock, the switch component drives the lock element to move so as to release the lock, wherein the switch component is a button component disposed only at one side of the rotation mechanism, the button component pushes the lock element to move axially directly or by a push block including a push rod, the rotation mechanism is provided with a longitudinal groove in an outer face thereof, and the push rod is configured to move in the longitudinal groove.

19. The quick assembly and disassembly device of a toilet cover according to claim 18, wherein further comprising a reposition element, the lock element is repositioned by the reposition element.

20. The quick assembly and disassembly device of a toilet cover according to claim 19, wherein the reposition element is a spring.

21. An implementation method of a quick assembly and disassembly device of a toilet cover, wherein:

providing a rotation mechanism having a lock element, both ends of the lock element are respectively disposed with a lock catch, the lock element moves axially or rotates to drive the lock catch to lock to a lock groove of an insert pin of a support pin or to release a lock;

providing at least one switch component, the switch component is assembled to an external side of two supports, the switch component drives the lock element to move axially or rotate to release the lock;

providing an elastic element to reposition the lock element, wherein the switch component is a button component disposed only at one side of the rotation mechanism, the button component pushes the lock element to move axially directly or by a push block including a push rod, the rotation mechanism is provided with a longitudinal groove in an outer face thereof, and the push rod is configured to move in the longitudinal groove.

* * * * *